United States Patent [19]

Nishikawa et al.

[11] Patent Number: 4,578,981

[45] Date of Patent: Apr. 1, 1986

[54] APPARATUS FOR SUPPORTING RAM

[75] Inventors: Hirotaka Nishikawa, Sagamihara; Yoshibumi Arai, Tokyo, both of Japan

[73] Assignee: Toyo Seikan Kaisha Limited, Tokyo, Japan

[21] Appl. No.: 620,601

[22] Filed: Jun. 14, 1984

[51] Int. Cl.[4] ..... B21D 22/00

[52] U.S. Cl. ..... 72/347; 308/5 R; 72/349

[58] Field of Search ..... 72/347–349; 208/5 R, 3 A

[56] References Cited

U.S. PATENT DOCUMENTS 2,924,491 2/1960 Wallgren ..... 308/5 R 3,003,411 10/1961 Judd ..... 308/5 R 3,168,013 2/1965 Williamson ..... 308/5 R 3,735,629 5/1973 Paramonoff ..... 72/349

*Primary Examiner*—Leon Gilden

*Attorney, Agent, or Firm*—Armstrong, Nikaido, Marmelstein & Kubovcik

[57] ABSTRACT

An apparatus for supporting an elongated ram which is adapted to reciprocate horizontally at a high velocity is provided. The apparatus comprises a slide yoke fixed onto the base of the ram for driving the ram, the slide yoke comprising at least two sets of hydrostatic pressure sliding oil pockets in the longitudinal direction thereof; and a hydrostatic pressure bearing for supporting the ram, the hydrostatic pressure bearing having at least three sets of oil pockets in the longitudinal direction thereof which are spaced with bushings therebetween.

2 Claims, 19 Drawing Figures

APPARATUS FOR SUPPORTING RAM

BACKGROUND OF THE INVENTION

This invention relates to an apparatus for supporting a ram and, more particularly, to an apparatus for supporting a ram which is adapted to reciprocate horizontally in a high velocity.

An elongated ram which is adapted to reciprocate horizontally in a high velocity, e.g. an elongated ram which is provided with a punch for redrawing and ironing a metallic can on its nose, and has its base fixed on a slide yoke and is supported by bearings, is driven usually to a high-speed reciprocation by a crank mechanism through the slide yoke. In this case, it is preferable that a hydrostatic bearing device be employed for prevention of heat generation and wear on a sliding zone of the slide yoke and the ram. However, the hydrostatic bearing device proposed hitherto is not satisfactory, since it involves the problem that a deflection will result on the ram in case of high-speed reciprocation (200 strokes per minute, for example).

A final thickness of the sidewall portion of a redrawn and ironed can body is normally very thin such as to be about 0.10 to 0.15 mm, and, therefore, a dislocation of the alignment between the punch and the ironing dies due to a slight deflection of the ram may exert an excessive load locally on the sidewall portion of the can body, thereby to incur rupture of the sidewall portion.

SUMMARY OF THE INVENTION

The object of the invention is to provide an apparatus for supporting hydrostatically an elongated ram, wherein reduced deflection will be caused on the ram even in case of a high-speed horizontal reciprocation.

According to the invention, there is provided an apparatus for supporting an elongated ram which is adapted to reciprocate horizontally at a high velocity, which comprises: a slide yoke fixed onto the base of the ram for driving the ram, the slide yoke comprising at least two sets of hydrostatic pressure sliding oil pockets in the longitudinal direction thereof; and a hydrostatic pressure bearing for supporting the ram, the hydrostatic pressure bearing having at least three sets of oil pockets in the longitudinal direction thereof which are spaced with bushings therebetween.

The above and other objects, features and advantages of the invention will be apparent from the following description when the same is read in conjunction with the accompanying drawings.

DETAILED DESCRIPTION OF THE PREFERRED EMBODIMENT

Figure 1A:
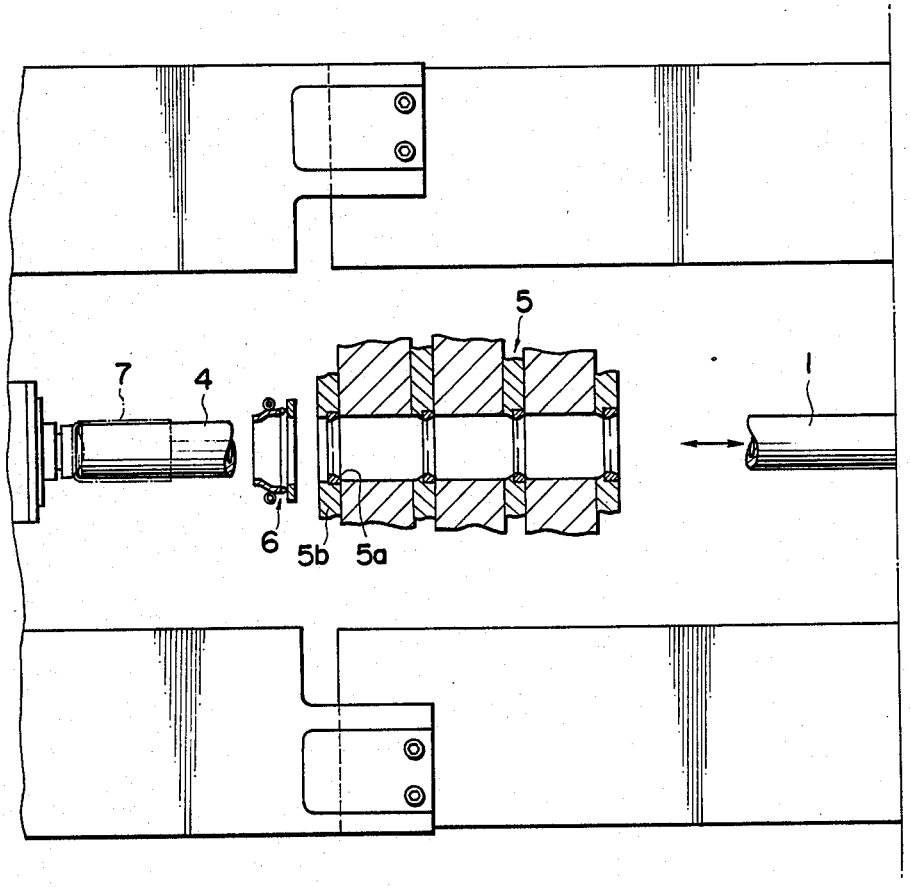
FIGS. 1A & 1B are a plan view placed on per FIG. 1, partly cut, of a main part of a redrawing-ironing apparatus to which a ram supporting apparatus of an embodiment according to the invention is applicable.
Figure 1:
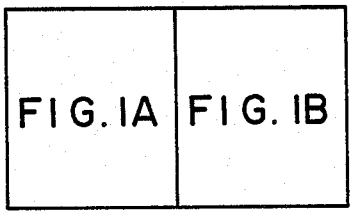
Figure 1B:
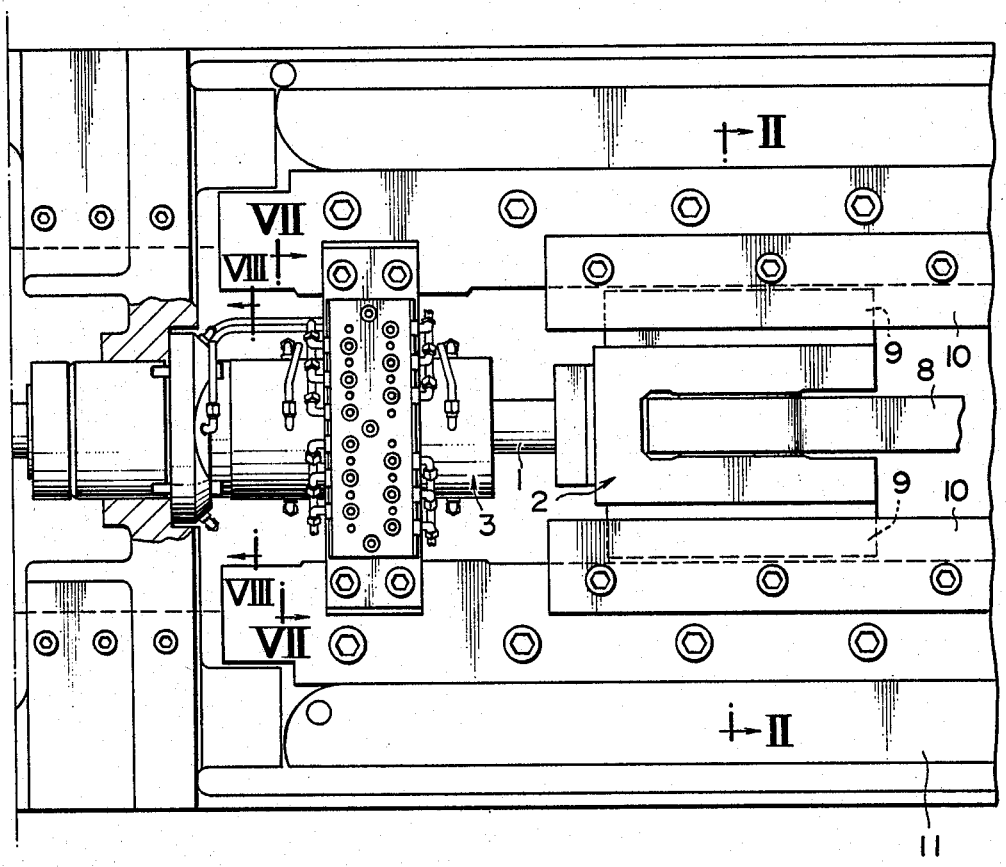

FIG. 1 represents a main part of one example of a redrawing-ironing apparatus in which a ram 1 has its base fixed on a front end portion of a slide yoke 2. A numeral 3 denotes a hydrostatic bearing system to bear the ram 1, and a redrawing-ironing punch 4 is installed on the nose of the ram 1. A numeral 5 denotes a redrawing-ironing die means, and 6 denotes a stripper for pulling a redrawn and ironed can body 7 off the punch 4.

Figure 2:
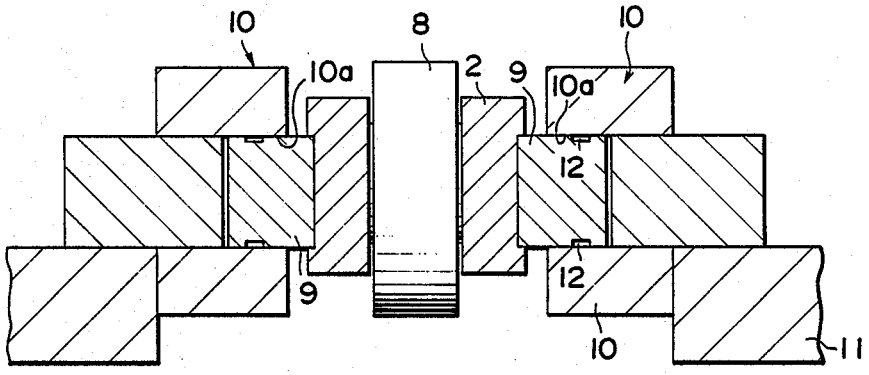
FIG. 2 is a vertical sectional view taken along line II—II of FIG. 1B, showing a slide yoke and a sliding member therefor.

As illustrated in FIG. 2, the slide yoke 2 on whose front end portion a base portion of the ram 1 is fixed, has one pair of sliding members 9 adapted to slide along upper and lower hydrostatic pressure sliding surfaces 10*a* of slide rails 10, by a crank mechanism (not illustrated) including a connecting rod 8, thus reciprocating horizontally. The slide rails 10 are fixed on a frame 11.

Figure 3:
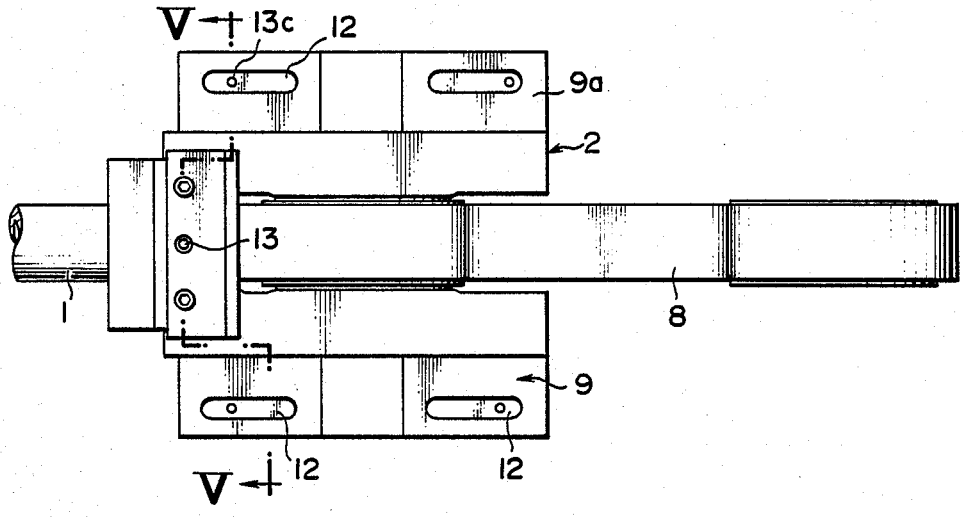
FIG. 3 is a plan view of the slide yoke of the apparatus of FIG. 1B.
Figure 4:
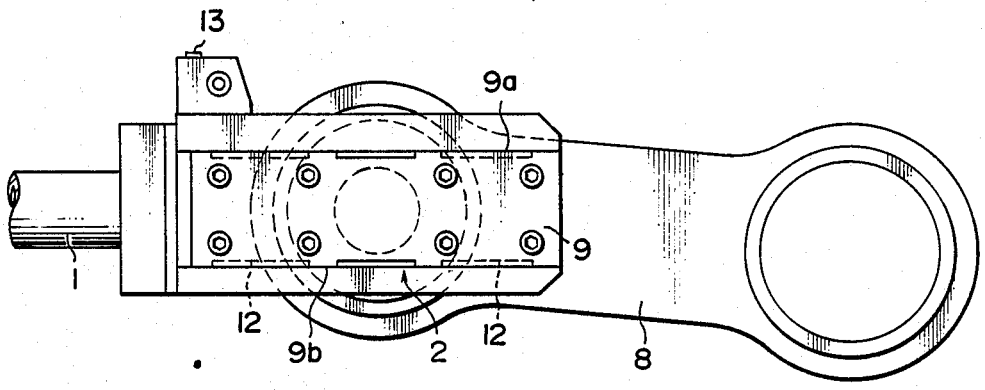
FIG. 4 is a side view of the slide yoke of FIG. 3.
Figure 5:
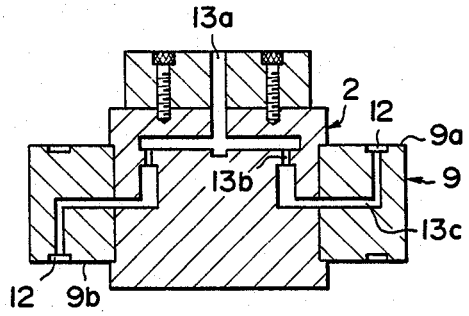
FIG. 5 is a vertical sectional view taken along line V—V of FIG. 3.
Figure 6A:
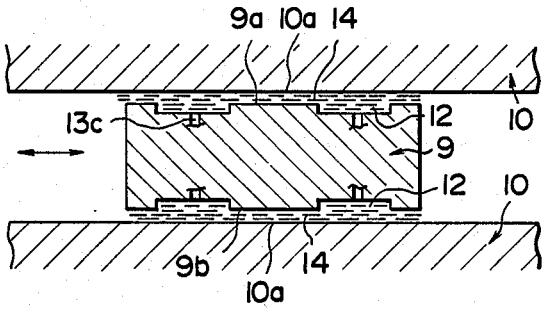
FIG. 6 is an explanatory vertical sectional view taken longitudinally of the sliding member of the slide yoke, wherein FIG. 6(*a*) and FIG. 6 (*f*) are drawings representing the cases of this invention, and FIGS. 6(*b*), (*c*), (*d*) and (*e*) are drawings representing the cases of comparative examples.
Figure 6B:
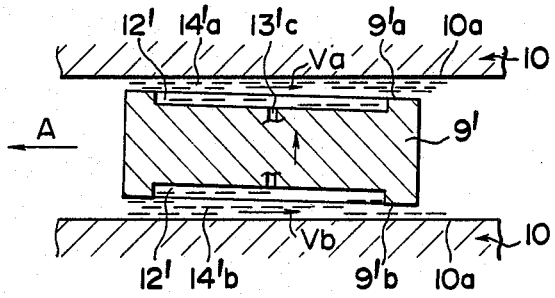
Figure 6C:
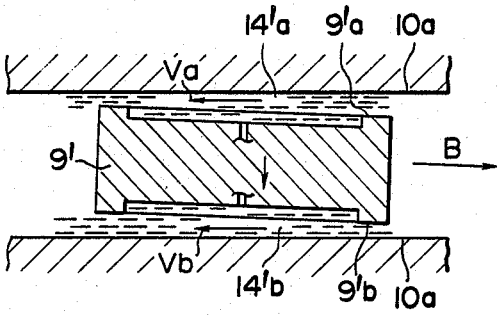
Figure 6D:
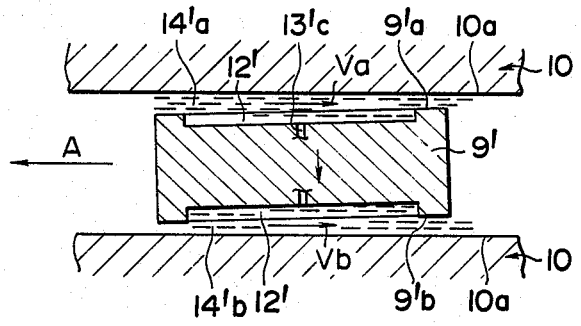
Figure 6E:
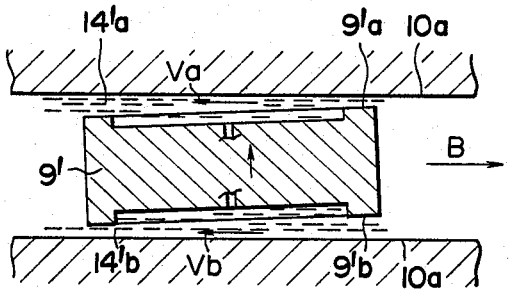
Figure 6F:
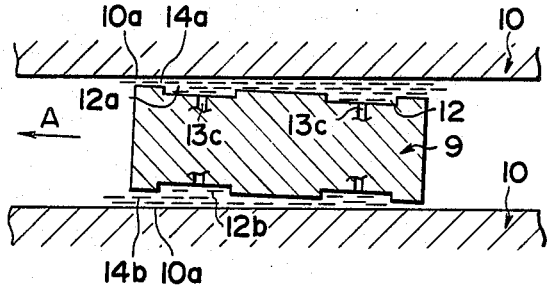

As shown in FIG. 3, FIG. 4 and FIG. 5, there are provided two sets of slender hydrostatic pressure sliding oil pockets 12 in the longitudinal direction, that is, the direction in which the ram 1 moves, one set thereof being provided at positions opposite each other on the upper surface 9*a* and the lower surface 9*b* of each sliding member 9.

A primary pressure oil kept at a predetermined hydrostatic pressure (for example, a hydrostatic pressure oil at 100 kg/cm$^2$) is led to the oil pocket 12 from a pressure oil source (not illustrated) by way of a primary conduit hole 13*a*, an orifice 13*b* and a secondary conduit hole 13*c*, decreases in pressure when passing the orifice 13*b*, so that the oil pressure (secondary pressure) in the oil pocket 12 becomes, for example, 50 kg/cm$^2$ (FIG. 5). As shown in FIG. 6(*a*), a thin pressure oil film layer 14 (0.04 mm thick, for example) is formed between the upper surface 9*a* and the lower surface 9*b*, and the hydrostatic pressure sliding surface 10*a* opposite to each of them, and the sliding member 9 slides to reciprocate in the direction indicated by the arrow along the slide rail 10 with the oil film layer 14 therebetween. Therefore, the sliding member 9 and the slide rail 10 will be prevented from heating and wearing.

It is necessary to provide at least two sets of the oil pockets 12 in the longitudinal direction of each sliding member 9, so as to prevent the sliding member 9 from inclining, that is, ascending leftward and descending leftward, and thus the punch 4 from oscillating vertically.

Namely, as shown in FIGS. 6(*b*) and (*d*), in case where one set of oil pockets 12' are provided on each sliding member 9', since upper and lower pressure oil film layers 14'*a* and 14'*b* corresponding to the upper and lower oil pockets 12' are equal in average thickness, pressures exerting on both pressure oil film layers 14'*a* and 14'*b* are also equal (when thought excepting a pressure according to gravity working on the sliding member 9'), and thus restoring force for the inclination of each sliding member 9' as shown in FIGS. 6(*b*) and (*d*) scarcely functions.

Further, when the sliding member 9' moves at high speed in the direction indicated by arrow A as kept slanting higher leftward, as shown in FIG. 6(*b*), the oil in the clearance between the upper surface 9'*a* of the sliding member and a slide rail 10*a* flows relatively in the direction indicated by arrow Va shown in FIG. 6(*b*). In this case the clearance formed by the upper surface 9'*a* of the sliding member and the slide rail 10*a* becomes gradually wider in the oil flowing direction, and, therefore, a pressure working on the pressure oil film layer 14'*a* on the upper surface of the sliding member slightly drops to P'a.

On the other hand, the oil in the clearance between the lower surface 9'*b* of the sliding member and a slide rail 10*b* flows relatively in the direction indicated by arrow Vb shown in FIG. 6 (*b*). In this case, since the clearance formed by the lower surface 9'*b* of the sliding member and the slide rail 10*b* becomes gradually narrower in the oil flowing direction, a pressure exerting on the pressure oil film layer 14'*b* on the lower surface of the sliding member slightly rises to P'b.

Where the pressure exerting on the pressure oil film layer 14'*a* on the upper surface of the sliding member and also exerting on the pressure oil film layer 14'*b* on the lower surface of the sliding member come to a state P'a<P'b, the sliding member 9' moves upward so that the pressures on the pressure oil film layers 14'*a* and 14'*b* come to a state P'a=P'b.

Then, in FIG. 6(*c*) where the sliding member 9' moves at high speed in the direction indicated by the arrow B, the pressure exerting on the pressure oil film layer 14'*a* on the upper surface of the sliding member slightly rises to P''a, and the pressure exerting on the pressure oil film layer 14'*b* slightly drops to P''b. Therefore, the pressures exerting on both pressure oil film layers on the upper and lower surfaces of the sliding member become P''a >P''b, and thus the sliding member 9' moves downward so that the pressures come to a state P''a=P''b.

As shown in FIG. 6(*d*), a similar phenomenon will result in case where the inclination of the sliding member 9' is reversed such that it inclines higher rightward; when the sliding member 9' goes at high speed in the direction indicated by the arrow A, the sliding member 9' moves downward, and as shown in FIG. 6(*e*), on the other hand, when it goes in the direction indicated by the arrow B, the sliding member 9' moves upward. Such behavior of the sliding member 9' is due to a so-called wedge effect, which gets larger as the sliding speed increases.

In case where two oil pockets 12 are provided in the longitudinal direction of each sliding member 9, when the inclination becomes higher leftward, for example, as shown in FIG. 6(*f*), the thickness of the pressure oil film layer 14*a* corresponding to the left side upper oil pocket 12*a* becomes thinner than that of the pressure oil film layer 14*b* corresponding to the left side lower oil pocket 12*b*.

Then, since the pressure of a primary pressure oil is constant, the pressure Pa exerting on the upper pressure oil film layer 14*a* becomes higher than the pressure Pb exerting on the lower pressure oil film layer 14*b*, and thus a force working downward is exerted on the left end portion of the sliding member 9. Similarly a force working upward is exerted on the right end portion of the sliding member 9, and a restoring force to the inclination operates. As a result, as shown in FIG. 6(*a*), the upper surface 9*a* and the lower surface 9*b* of the sliding member 9 slide in substantial parallel with the hydrostatic pressure sliding surface 10*a*.

Figure 7:
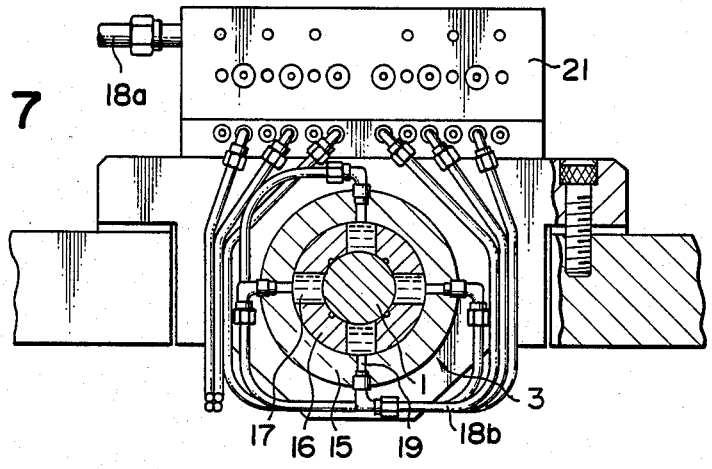
FIG. 7 is a vertical sectional view taken along line VII—VII of FIG. 1B, representing a bearing system for the ram.
Figure 8:
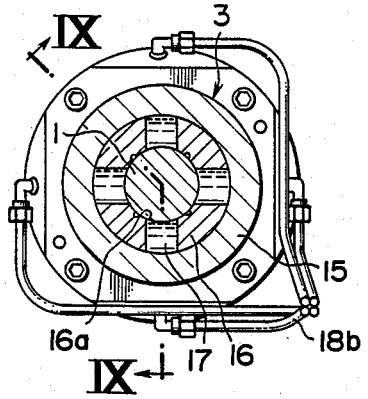
FIG. 8 is a vertical sectional view taken along line VIII—VIII of FIG. 1B, representing similarly the bearing system.
Figure 9:
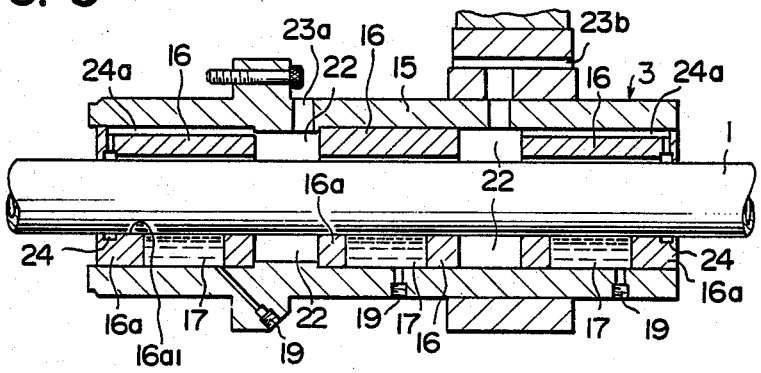
FIG. 9 is a sectional view taken on line IX—IX of FIG. 8, representing oil pockets disposed longitudinally of the ram.

FIG. 7, FIG. 8 and FIG. 9 represent the hydrostatic pressure bearing system 3 which bears the ram 1. The hydrostatic pressure bearing system 3 is provided with a cylindrical sleeve 15, bushings 16 and oil pockets 17. As shown in FIG. 7 and FIG. 8, one set of the oil pockets 17 consists of 4 pockets, each two pockets being disposed opposite to each other vertically and horizontally, and each oil pocket 17 is spaced with the bushing 16.

As shown in FIG. 9, the oil pockets 17 are provided in three sets in the longitudinal direction (or in the direction in which the ram 1 moves). A primary pressure oil (a hydrostatic pressure oil at, for example, 100 kg/cm$^2$) kept at a predetermined hydrostatic pressure is led to each oil pocket 17 from a pressure oil source (not illustrated) by way of a piping 18*a*, an orifice 18*c* (refer to FIG. 5) in a head 21, a piping 18*b* and a conduit hole 19, and the oil pressure (secondary pressure) in the oil pocket 17 works, for example, at 50 kg/cm$^2$.

There is formed a pressure oil film layer 20 (0.04 mm thick, for example; refer to FIG. 10) between the bushing 16 and the ram 1. Thus the ram 1 and the bushing 16 are prevented from heating and wearing. An inner surface 16*a* of each bushing 16 is so formed as to position substantially on the same phantom cylindrical surface by a simultaneous grinding. As a result, the inner surface 16*a* is formed so as to have a radial deviation between each set of about 5 $\mu$m or below. It is not desirable that the above deviation exceeds about 5 $\mu$m, since a wedge effect becomes too large to impede a deflection of the ram 1. The pressure oil in the oil pocket 17 flows out by way of oil reservoirs 22, and conduit holes 23*a*, 23*b*.

An oil groove 24 formed on an outside bushing 16*a* communicates with the oil reservoir 22 through a conduit hole 24*a*. The oil groove 24, for example, that on the left side of the drawing, feeds oil to the clearance between an inner surface 16$a_1$ of the left side bushing 16*a* and the ram 1, and thus prevents deterioration of a bearing function due to cavitation which tends to occur as an oil film gets thinner, and also roughening of the inner surface 16$a_1$, thereby ensuring a long life of the bushing.

It is necessary that the oil pockets 17 are provided in at least 3 sets in the longitudinal direction of the sleeve 15 so as to prevent the ram 1 from deflecting, and the punch 4 from oscillating, particularly during high-speed movement.

The reason is deemed as follows. In case oil pockets 17' are provided in two sets and consequently metal bushings 16' in two sets, a maximum linear speed of the ram 1 during high-speed movement (200 strokes per minute, for example) will be caused about at the middle of the strokes and becomes 8.2 m/sec, for example.

Figure 10A:
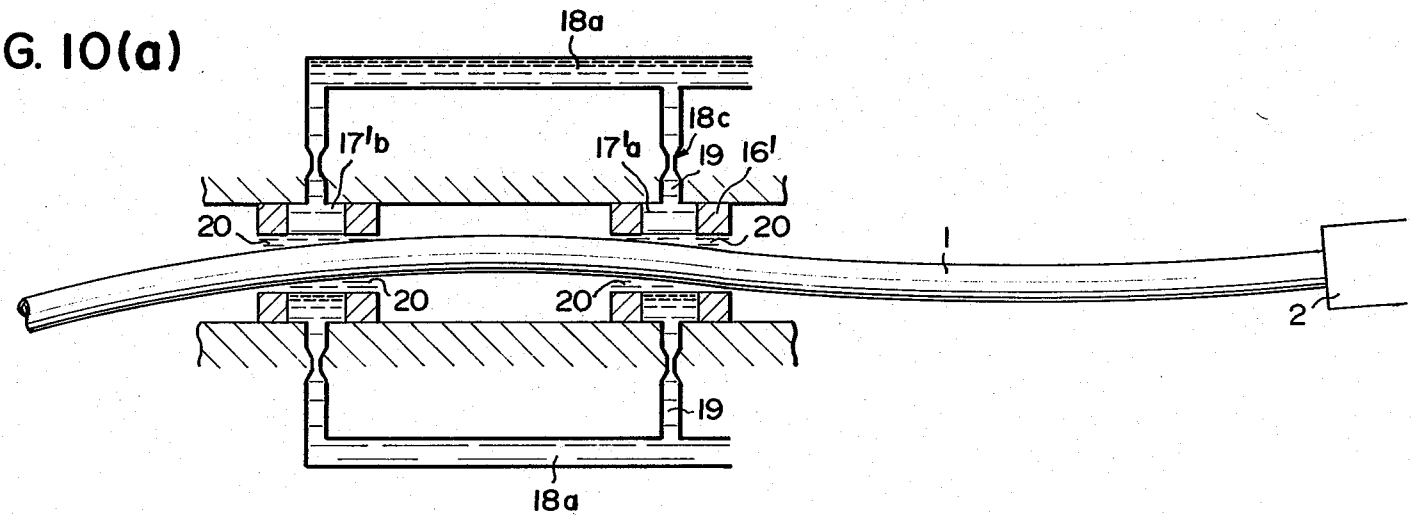
FIG. 10 is an explanatory sectional view of a main part of the ram running longitudinally of the bearing system, wherein FIG. 10(*a*) is a drawing representing the case of comparative example, and FIG. 10(*b*) is a drawing representing the of this invention.
Figure 10B:
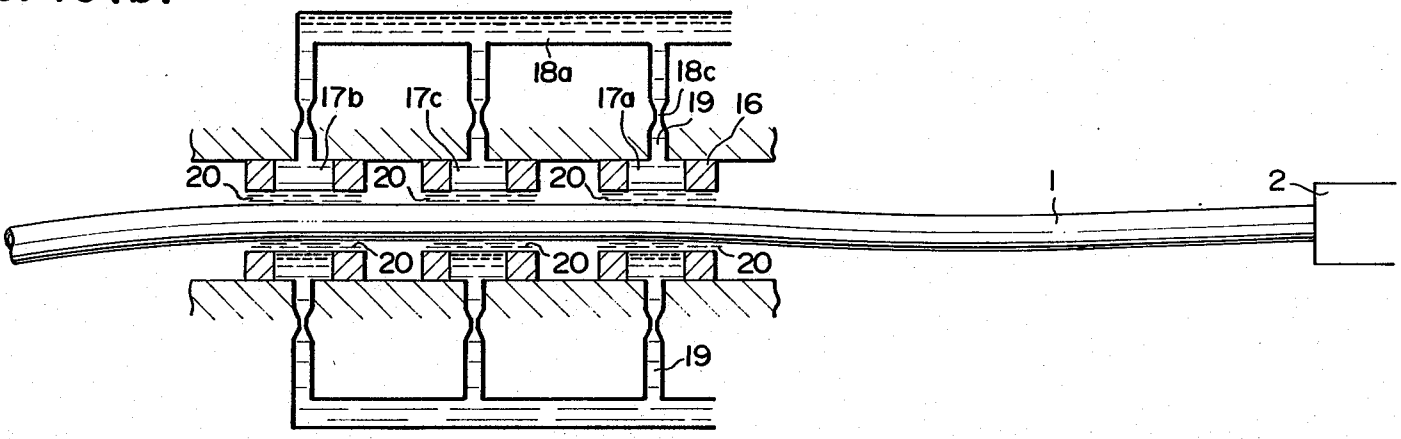

In this case, the ram 1 will be curved upward on its own weight, as shown in FIG. 10(*a*), in the middle of a right side oil pocket 17'*a* and a left side oil pocket 17'*b*, and the portion of the ram 1 positioned at the above middle will be slightly higher (upward in FIG. 10(*a*)) than the portions thereof positioned along each oil pockets.

Further, the portion of the ram 1 along the right side oil pocket 17'*a* is inclined slightly lower rightward, and the portion along the left side oil pocket 17'*b* is inclined slightly to lower leftward. As in the case of the sliding member 9 of the slide yoke, the ram 1 moves slightly downward at the position of the right side oil pocket 17'*a* at its forward stroke (that is, a stroke moving leftward of the drawing), and slightly upward at the position of the left side oil pocket 17'*b* at the same stroke. As a result, the left side nose portion of the ram 1 on which the punch is mounted moves upward.

On the other hand, in a return stroke (that is, a stroke moving rightward of the drawing), the ram 1 moves slightly upward at a position of the right side oil pocket 17'*a* and also moves slightly downward at a position of the left side oil pocket 17'*b*.

The left side nose portion of the ram 1 moves downward consequently. Thus the position where the ram is supported at the bearing system is different vertically between at the forward and return strokes of the ram 1, and the difference is enlarged at the nose portion of the ram 1, and, therefore, the punch 4 mounted on the nose of the ram 1 will be subjected to large vertical oscillations.

In an apparatus like redrawing-ironing can body forming machine, wherein a slender ram is supported with its one end fixed on a slide yoke and reciprocated horizontally by a crank mechanism through a connecting rod, the ram itself vibrates in accordance with the vibration of the apparatus. In the prior art, therefore, the deflection of the ram consists of a deflection due to vibrations of the apparatus and a deflection due to the above-mentioned wedge effect, thus developing to a big deflection from duplication of both the two deflections.

Under such circumstances, the deflection of the ram usually can be minimized by enlarging the outside diameter of the ram and increasing its rigidity against the deflection of the ram. However, in the redrawing-ironing can body forming machine the outside diameter of the ram 1 must be smaller than that of the punch 4, namely, the outside diameter of the ram is restricted to cope with the size of the sidewall portion of the can body to be formed.

However, the oscillation of the punch 4 can be minimized without enlarging the ram outside diameter under the above condition, by suppressing the vertical movement of the ram due to the above-mentioned wedge effect by the following arrangement wherein, as shown in FIG. 10(*b*), at least 3 sets of the bushings 16 are provided close to each other in the hydrostatic pressure oil bearing, namely, a bushing of the hydrostatic pressure oil bearing is provided additionally in the middle of two bushings 16' of the hydrostatic pressure oil bearing in the prior art shown in FIG. 10(*a*).

As described above, in case of two bushings, the ram 1 is curved upward due to flexure from its own weight in the middle of the two bushings of the hydrostatic pressure oil bearing, as shown in FIG. 10(*a*), and the center portion of the ram comes higher (upward in the drawing) than the portions of the ram in the two bushings of the hydrostatic pressure oil bearing. Therefore, the portion of the ram positioned high (upward in the drawing) can be pushed down by providing a bushing additionally in the middle of the two bushings of the hydrostatic pressure oil bearing, and thus the ram 1 through the three bushings can be held substantially linearly as shown in FIG. 10(*b*). The inclination of the ram in each bushing of the hydrostatic pressure oil bearing is improved as a result, the deflection of the ram due to the above-mentioned wedge effect is eliminated unlike the prior art, and thus the oscillation of the punch 4 can be improved substantially on the whole.

As described above, the arrangement wherein at least two sets of hydrostatic pressure sliding oil pockets are provided in the longitudinal direction on each sliding member of the slide yoke, and the ram is supported by the hydrostatic pressure bearing provided with at least 3 sets of oil pockets in the longitudinal direction thereof is advantageous in that it can prevent the elongated ram substantially from heating and wearing, and decrease the deflection of the ram remarkably even in case of its high-speed reciprocation.

Therefore, when the arrangement is applied on a redrawing-ironing can body forming apparatus, rupture in the can body sidewall portion at the die means, damages of the punch and the dies, and further troubles liable to occur when the can body is pulled off with the stripper can be prevented, and a redrawing-ironing can body forming can be realized even at a high-speed operation which was impossible heretofore.

The ram supporting device will be then described for its operation with reference to an example.

EXAMPLE

In the redrawing-ironing apparatus of the type shown in FIG. 1, the amplitude of oscillation of the punch 4 at a position of the final die 5*a* of the die means 5 was measured for combination of the cases where the oil pockets 12 provided in the longitudinal direction of the sliding member 9 were in two sets and one set, and the other cases where the oil pocket 17 provided in the longitudinal direction of the hydrostatic pressure bearing system 3 of the ram 1 were in three sets and two sets.

Figure 11:
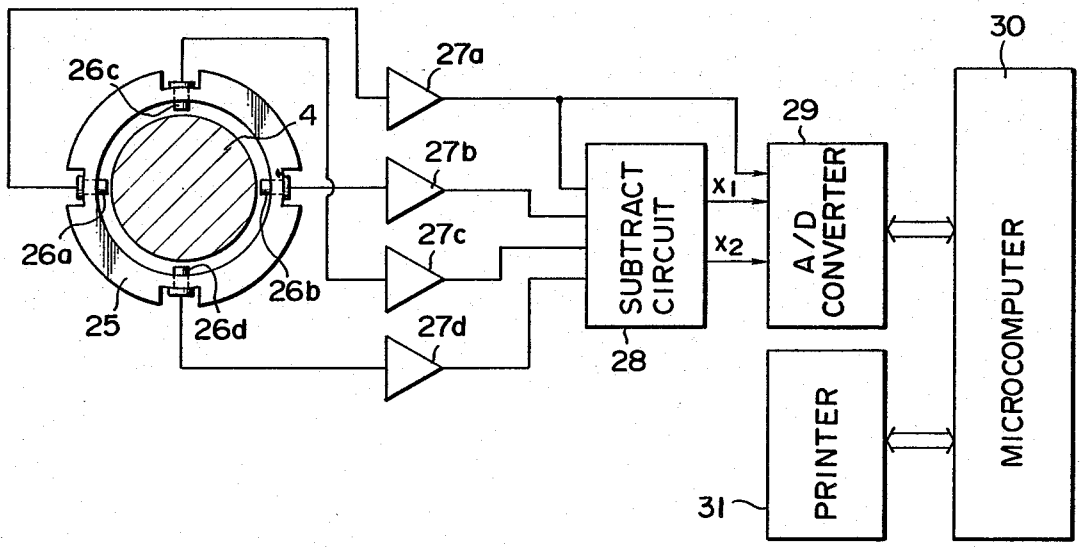
FIG. 11 is a block diagram of a deflection measuring apparatus for the ram.

The constitution of an amplitude measuring apparatus is shown in FIG. 11. A numeral 25 denotes a ring for mounting displacement sensors (of an eddy current type for measuring a distance to the surface portion of the punch 4 opposite thereto; measuring precision being 1 μm) 26*a*, 26*b*, 26*c* and 26*d*; 27*a*, 27*b*, 27*c* and 27*d* denote amplifiers; 28 denotes a subtraction circuit, which operates for subtraction between outputs of the amplifiers 27*a* and 27*b* and also for subtraction between outputs of the amplifiers 27*c* and 27*d*. A numeral 29 denotes an A-D converter, the output of which is inputted to a microcomputer 30. A data obtained through the microcomputer 30 is outputted to a printer 31.

The ring 5*b* for holding the die 5*a* (refer to FIG. 1) is demounted, and the ring 25 is installed at the position so that the displacement sensors 26*c*, 26*d* will face vertically and the sensors 26*a*, 26*b* will face horizontally. Therefore, a subtracted value $x_1$ of the outputs of the amplifiers 27*a* and 27*b* indicates the value double of a horizontal displacement of the center of the punch 4 to the center of the ring 25.

Similarly a subtracted value $x_2$ of the outputs of the amplifiers 27*c* and 27*d* indicates the value double of a vertical displacement of the center of the punch 4 to the center of the ring 25. A sampling of data was carried out at every 2 mS, and a MAX value obtained on the microcomputer 30 during the period of measurement (the maximum value including + and − of values read therefor, indicating a maximum displacement of the center of the punch 4) was displayed on the printer 31.

The oil pocket 12 provided on the sliding member 9 was standardized at 10 mm in length, 13 mm in width and 8 mm in depth; a primary pressure of the pressure oil was set at 100 kg/cm$^2$ and a secondary pressure was set at 50 kg/cm$^2$.

The oil pocket 17 provided on the hydrostatic pressure bearing system 3 was standardized at 56 mm in length and 22 mm in width, the bushing inner surface 16*a* at 20 mm in length, and the oil reservoir 22 at 45 mm (in the case of 3 sets) and 185 mm (in the case of 2 sets) in length; a primary pressure of the pressure oil was set at 100 kg/cm$^2$ and a secondary pressure was set at 50 kg/cm$^2$. The diameter of ram 1 was 50 mm, the length from the base of the ram 1 to the leading end of the punch 4 was 1345 mm, and the stroke of the ram 1 was 650 mm.

Results obtained by measuring the displacements in case the number of strokes per minute of the ram 1 was changed, are given in Table 1.

TABLE 1

| Number of sets of oil pockets 17 | Number of sets of oil pockets 12 | 120(1) MAX value (μm) | 180(1) MAX value (μm) | 230(1) MAX value (μm) |
|---|---|---|---|---|
| 3 | 2 | 108 | 121 | 125 |

TABLE 1-continued

| Number of sets of oil pockets 17 | Number of sets of oil pockets 12 | 120(1) MAX value (μm) | 180(1) MAX value (μm) | 230(1) MAX value (μm) |
|---|---|---|---|---|
| 2 | 2 | 163 | 234 | 302 |
| 2 | 1 | 297 | 346 | 435 |

NOTE: (1)Number of strokes per minute

What is claimed is:

1. Apparatus for supporting an elongated ram having a free end and a base portion opposite to the free end which is adapted to reciprocate horizontally at a high velocity, which comprises:

(a) a slide yoke fixed onto the base portion of the ram for driving the ram, the slide yoke having at least two sets of hydrostatic pressure sliding oil pockets in the longitudinal direction thereof; and (b) a hydrostatic pressure bearing for supporting the ram which is disposed to support a portion of the ram relatively close to the base portion when the ram has reached the end portion of an advancing stroke thereof, the bearing having at least three sets of a plurality of oil pockets provided close to each other in the longitudinal direction thereof, the oil pockets of each set being spaced circumferentially about said bearing surfaces with bushings therebetween, and the inner surfaces of all sets of the bushings being positioned substantially on the same phantom cylindrical surface, whereby the deflection of the free end of the ram is minimized.

2. Apparatus as claimed in claim 1, wherein a redrawing-ironing punch is installed on the nose of the ram.

* * * * *